US008316598B2

(12) United States Patent
Flynn et al.

(10) Patent No.: US 8,316,598 B2
(45) Date of Patent: Nov. 27, 2012

(54) TRANSLUCENT PANEL

(75) Inventors: Gregory Flynn, Collon (IE); James Carolan, County Cavan (IE)

(73) Assignee: Kingspan Research and Developments Limited, Kingscourt, County Cavan (IE)

( * ) Notice: Subject to any disclaimer, the term of this patent is extended or adjusted under 35 U.S.C. 154(b) by 350 days.

(21) Appl. No.: 12/227,797

(22) PCT Filed: Jun. 11, 2007

(86) PCT No.: PCT/IE2007/000054

§ 371 (c)(1),
(2), (4) Date: Nov. 26, 2008

(87) PCT Pub. No.: WO2007/144861

PCT Pub. Date: Dec. 21, 2007

(65) Prior Publication Data

US 2009/0241443 A1 Oct. 1, 2009

(30) Foreign Application Priority Data

Jun. 13, 2006 (IE) ..... 2006/0445

(51) Int. Cl.

| | |
|---|---|
| ***E04B 2/88*** | (2006.01) |
| ***E04C 1/42*** | (2006.01) |
| ***E04C 2/20*** | (2006.01) |
| ***E04C 2/54*** | (2006.01) |

(52) U.S. Cl. ..... 52/235; 52/306; 52/309.1

(58) Field of Classification Search ..... 52/235, 52/309.1, 309.11, 306, 475.1, 478, 483.1, 52/763, 778, 779, 510

See application file for complete search history.

(56) References Cited

U.S. PATENT DOCUMENTS

| | | | | | |
|---|---|---|---|---|---|
| 4,299,070 | A | * | 11/1981 | Oltmanns et al. | 52/309.11 |
| 4,370,372 | A | * | 1/1983 | Higgins et al. | 428/116 |
| 4,979,345 | A | * | 12/1990 | Celsi | 52/481.1 |
| 4,998,395 | A | * | 3/1991 | Bezner | 52/563 |
| 5,052,164 | A | * | 10/1991 | Sandow | 52/786.13 |
| 5,425,210 | A | * | 6/1995 | Zafir | 52/404.4 |
| 5,437,129 | A | * | 8/1995 | Konstantin | 52/200 |
| 5,617,682 | A | * | 4/1997 | Christopher | 52/200 |
| 5,996,301 | A | * | 12/1999 | Conterno | 52/563 |
| 6,151,849 | A | * | 11/2000 | Twigg et al. | 52/208 |
| 6,164,024 | A | * | 12/2000 | Konstantin | 52/200 |

(Continued)

FOREIGN PATENT DOCUMENTS

CH 690922 A5 * 2/2001

(Continued)

*Primary Examiner* — Basil Katcheves
*Assistant Examiner* — Rodney Mintz
(74) *Attorney, Agent, or Firm* — Jacobson Holman PLLC

(57) ABSTRACT

A translucent wall panel includes a single body of translucent polycarbonate material having skin walls and a multiwall support extending between the skin walls. The skin walls include an outer weather wall, an inner liner wall, a longitudinally extending first side and a longitudinally extending second side opposite to the first side. The first side has outer projecting and recess parts and the second side has outer projecting and recess parts. The projecting and recess parts of the first side are of mating form with corresponding recess and projecting parts respectively of the second side for engagement between the first side of one panel and the second side of another like panel. The sides have additional spacer recesses which are aligned so that when two similar panels are aligned adjacent to one another a spacer element bridges a gap between the panels and a support frame element such as a purlin.

9 Claims, 7 Drawing Sheets

U.S. PATENT DOCUMENTS

| | | | | |
|---|---|---|---|---|
| 6,298,627 | B1 * | 10/2001 | Richardson | 52/582.1 |
| 6,536,175 | B2 * | 3/2003 | Conterno | 52/489.1 |
| 6,715,245 | B2 * | 4/2004 | Lewkowitz | 52/208 |
| 7,313,893 | B2 * | 1/2008 | Voegele, Jr. | 52/461 |
| 7,441,379 | B2 * | 10/2008 | Konstantin | 52/200 |
| 7,546,708 | B2 * | 6/2009 | Konstantin | 52/200 |
| 7,562,504 | B2 * | 7/2009 | Herbst et al. | 52/461 |
| 7,661,234 | B2 * | 2/2010 | Voegele, Jr. | 52/466 |
| 7,665,254 | B2 * | 2/2010 | Brandner | 52/173.3 |
| 7,694,478 | B2 * | 4/2010 | Zahner | 52/302.3 |
| 7,765,760 | B2 * | 8/2010 | Konstantin | 52/466 |
| 7,788,869 | B2 * | 9/2010 | Voegele, Jr. | 52/461 |
| 7,926,236 | B2 * | 4/2011 | Konstantin | 52/466 |
| 7,992,361 | B2 * | 8/2011 | Thiagarajan et al. | 52/783.1 |
| 8,056,289 | B1 * | 11/2011 | Konstantin | 52/204.591 |
| 2004/0261336 | A1 * | 12/2004 | Konstantin | 52/200 |
| 2005/0102943 | A1 * | 5/2005 | Voegele, Jr. | 52/506.01 |
| 2007/0033893 | A1 * | 2/2007 | Voegele, Jr. | 52/466 |
| 2007/0240369 | A1 * | 10/2007 | Brandner | 52/173.3 |
| 2008/0053026 | A1 * | 3/2008 | Voegele, Jr. | 52/582.1 |
| 2009/0025335 | A1 * | 1/2009 | Flynn et al. | 52/792.11 |
| 2009/0049770 | A1 * | 2/2009 | Konstantin | 52/200 |
| 2009/0100773 | A1 * | 4/2009 | Flynn et al. | 52/306 |
| 2009/0133341 | A1 * | 5/2009 | Kontos | 52/202 |
| 2009/0293241 | A1 * | 12/2009 | Voegele, Jr. | 24/457 |
| 2009/0301018 | A1 * | 12/2009 | Voegele, Jr. | 52/466 |
| 2010/0126099 | A1 * | 5/2010 | Ben-Zvi | 52/582.1 |
| 2010/0132293 | A1 * | 6/2010 | Voegele et al. | 52/402 |
| 2010/0212238 | A1 * | 8/2010 | Voegele et al. | 52/204.595 |
| 2010/0242397 | A1 * | 9/2010 | Givoni et al. | 52/588.1 |
| 2010/0287858 | A1 * | 11/2010 | Israeli et al. | 52/220.7 |
| 2011/0179739 | A1 * | 7/2011 | Konstantin | 52/582.1 |
| 2012/0117901 | A1 * | 5/2012 | Loyd | 52/235 |

FOREIGN PATENT DOCUMENTS

| | | | | |
|---|---|---|---|---|
| DE | 78 21 517 | | | 10/1978 |
| DE | 87 09 349 | | | 8/1987 |
| DE | 91 15 940 | | | 2/1992 |
| DE | 102 08 687 | | | 9/2003 |
| DE | 20309516 | U1 | * | 9/2003 |
| EP | 0 006 431 | | | 1/1980 |
| EP | 339216 | A1 | * | 11/1989 |
| EP | 381339 | A2 | * | 8/1990 |
| EP | 0 624 696 | | | 11/1994 |
| FR | 2623228 | A1 | * | 5/1989 |
| FR | 2 757 198 | | | 6/1998 |
| GB | 2106159 | A | * | 4/1983 |
| GB | 2 325 678 | | | 12/1998 |
| GB | 2413808 | A | * | 11/2005 |
| JP | 08174733 | A | * | 7/1996 |
| JP | 09060154 | A | * | 3/1997 |
| JP | 09154990 | A | * | 6/1997 |
| JP | 11013246 | A | * | 1/1999 |
| JP | 2011026926 | A | * | 2/2011 |
| WO | WO 2008051723 | A2 | * | 5/2008 |

* cited by examiner

TRANSLUCENT PANEL

This is a national stage of PCT/IE2007/000054 filed Jun. 11, 2007 and published in English, which has a priority of Irish No. 2006/0445 filed Jun. 13, 2006, hereby incorporated by reference.

INTRODUCTION

The invention relates to a wall panel.

In general, translucent wall panels comprise an outer translucent weather sheet and an inner translucent liner sheet.

One of the problems with conventional translucent wall panels is that they are not efficient insulators and the rate of heat loss through the translucent panels is relatively high. Another problem is that convention translucent wall panels must be relatively thick to achieve desired insulation and spanability properties. Thus where available, the panels are expensive in material usage. Generally conventional integrated windows are used which are particularly expensive.

This invention is directed towards providing a wall panel which will address at least some of these problems.

STATEMENTS OF INVENTION

According to the invention there is provided a wall panel comprising a single body of translucent material, the single body comprising skin wall means and a multiwall support extending between the skin wall means, the skin walls and multiwall support all being of translucent material, and the skin wall means comprising an outer wall, an inner wall, a longitudinally extending first side, and a longitudinally extending second side opposite to the first side, the first side having outer projecting and recess parts and the second side having outer projecting and recess parts, the projecting and recess parts of the first side being of mating form with corresponding recess and projecting parts respectively of the second side for engagement between the first side of one panel and the second side of another like panel.

In one embodiment the first side has an outer projecting part, an inner projecting part, and an intermediate recess part between the outer and inner projecting parts and the second side has an outer recess part an inner recess part and an intermediate projecting part between the inner and outer recess parts.

In one embodiment the second side of the panel has an integral hole for reception of a fixing. In this case the outer projecting part of the first side preferably extends to cover the fixing hole of a second side of another like panel. In this way the fixing is not visible in use.

In one embodiment the outer projecting part on the first side projects beyond the side edge defined by the inner projecting part and the outer recess part on the second side is recessed further than the inner recess part.

In a preferred embodiment at least one side has spacer recesses to receive a portion of a spacer bar. Both sides may have spacer recesses. The spacer recesses may be aligned.

In a preferred embodiment the translucent material comprises a translucent thermosetting material such as a polycarbonate material.

The invention also provides a wall structure incorporating a translucent panel of the invention.

In another aspect the invention provides a construction system comprising at least one translucent panel of the invention and a spacer means for bridging a gap between the panel and a support.

The spacer may comprise a spacer for supporting one edge of the translucent panel.

The spacer may comprise a spacer for supporting adjacent edges of two adjacent translucent panels.

The invention further provides a structure incorporating a construction system of the invention.

BRIEF DESCRIPTION OF THE DRAWINGS

The invention will be more clearly understood from the following description thereof given by way of example only, with reference to the accompanying drawings, in which.

DETAILED DESCRIPTION

Figure 1:
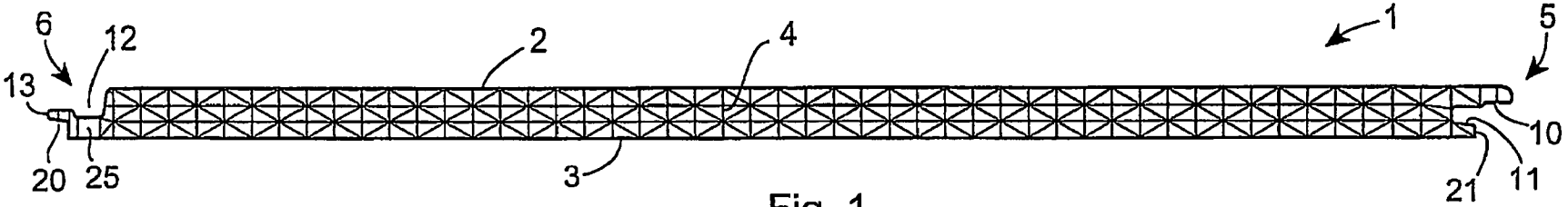
FIG. 1 is a cross-sectional view of a translucent wall panel according to the invention.

Referring to the drawings there is illustrated a translucent wall panel 1 comprising a single body of translucent polycarbonate material, the single body comprising skin wall means and a multiwall support 4 extending between the skin wall means. The skin means and the multiwall support are all of translucent polycarbonate material. The translucent wall panel may be of LEXAN THERMOCLEAR multiwall polycarbonate sheet from GE Structural Products. This material is highly resistant to sheet covering discoloration, loss of light and loss of strength due to weathering.

The skin wall means comprises an outer weather wall 2, an inner liner wall 3, a longitudinally extending first side 5 and a longitudinally extending second side 6 opposite to the first side.

The first side 5 has outer projecting and recess parts and the second side 6 has outer projecting and recess parts. The projecting and recess parts of the first side 5 are of mating form with corresponding recess and projecting parts respectively of the second side 6 for engagement between the first side 5 of one panel A and the second side of another like panel B as illustrated for example in FIG. 5.

Figure 2:
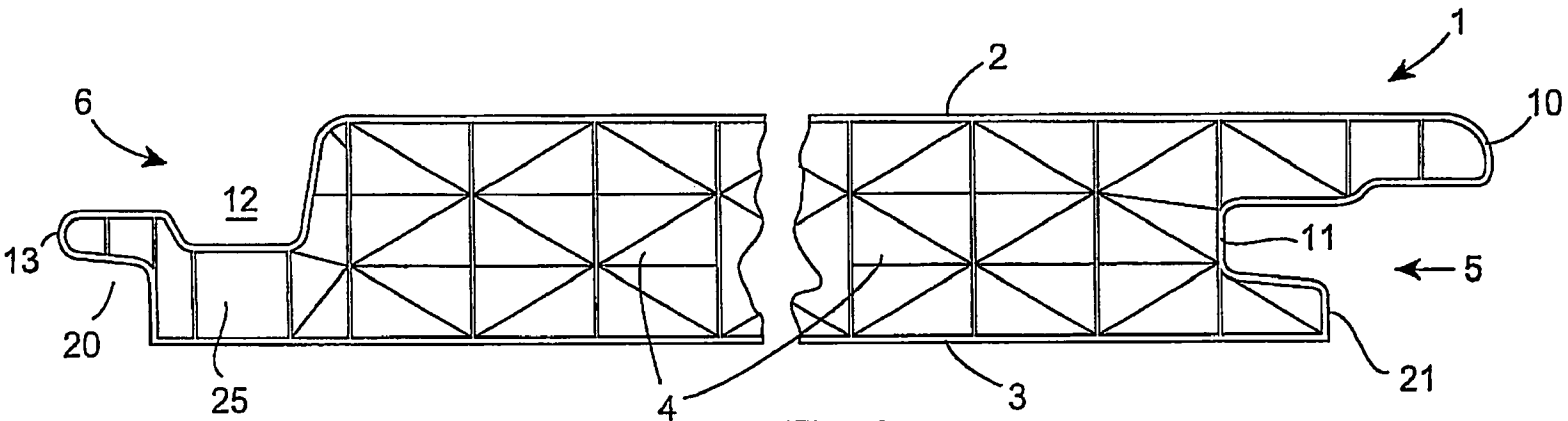
FIG. 2 is an enlarged view of the panel of FIG. 1.

In more detail and referring initially to FIGS. 1 and 2 the first side 5 has an outer projecting part 10, an inner projecting part 21 and an intermediate recess part 11 between the inner and outer projecting parts 10, 21. The second side 6 has an outer recess part 12, an inner recess part 20 and an intermediate projecting part 13 between the inner and outer recess parts 12, 20. The outer projecting part 10 on the first side 5 projects beyond the side margin defined by the inner projecting part 21. Similarly, the outer recess part 12 on the second side 6 is recessed further inboard than the inner recess part 20. The panel in the region of the second side 6 has an integral hole 25 for reception of a fixing 30.

Figure 3:
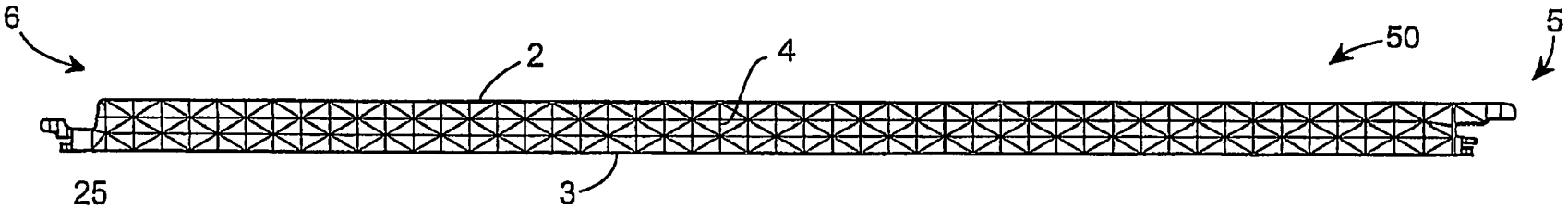
FIG. 3 is a cross-sectional view of another translucent wall panel according to the invention.
Figure 4:
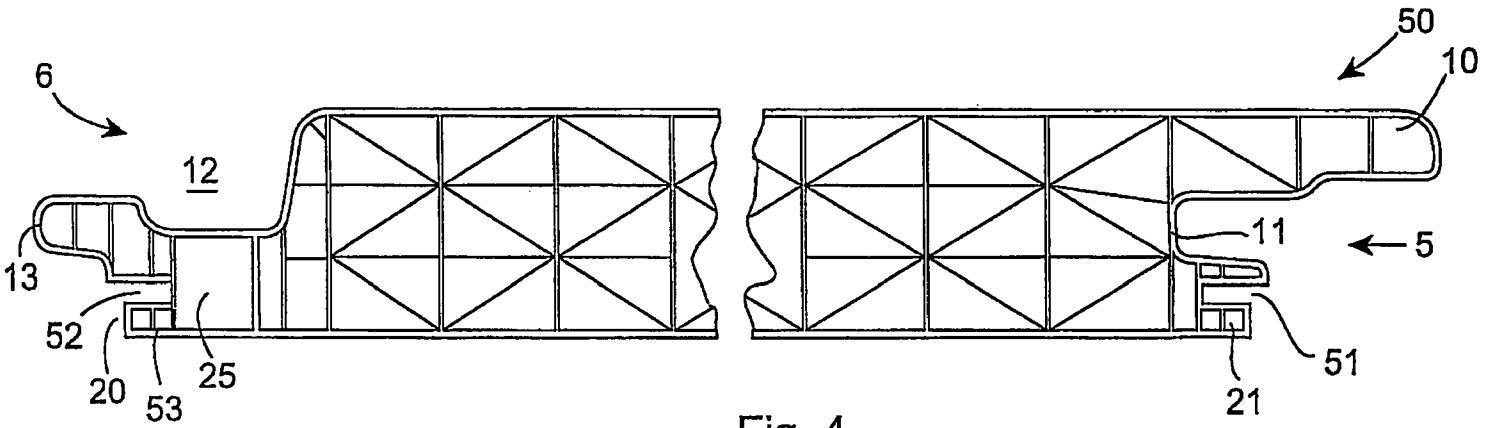
FIG. 4 is an enlarged view of the panel of FIG. 3.

Referring particularly to FIGS. 3 and 4 a translucent panel 50 is illustrated which is of similar construction to the panel of FIGS. 1 and 2 and like parts are assigned the same reference numerals. At least one and, in this case, both of the sides 5, 6 have additional spacer recesses 51, 52. For the side 5 the spacer recess is defined by an additional groove 51 formed in the projecting part 21. For the side 6 the spacer recess 52 is defined by the addition of an inner projecting part 53 which extends into the inner recess 20.

Figure 5:
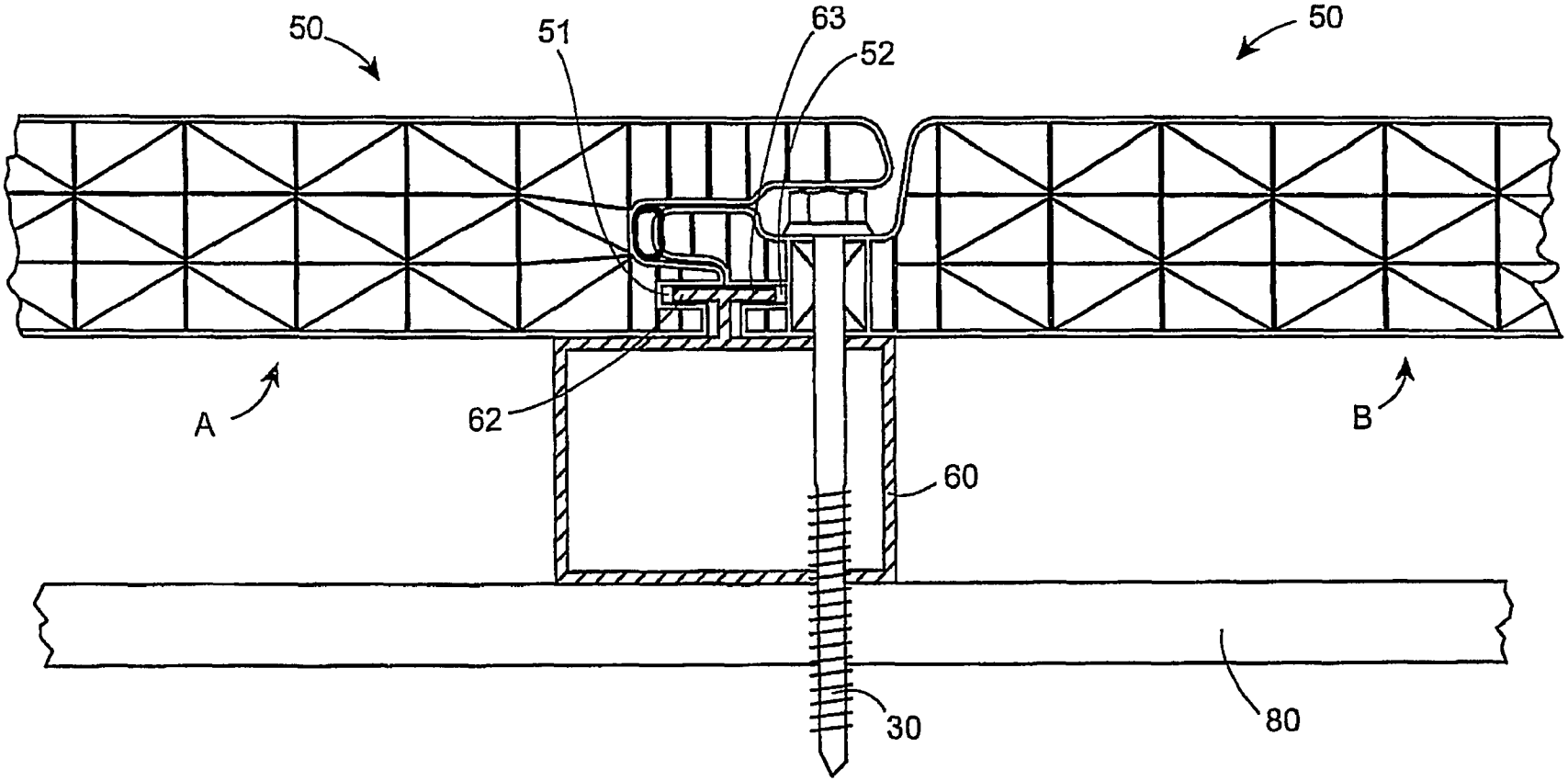
FIG. 5 is a cross-sectional view at a joint between two adjacent panels of FIGS. 3 and 4.
Figure 9:
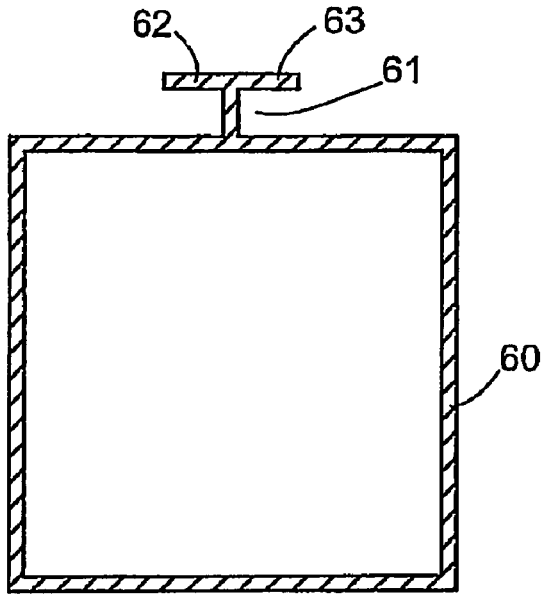
FIG. 9 is a cross-sectional view of a spacer element used in the system of FIG. 5.

The spacer recesses 51, 52 are aligned so that when two similar panels 50 are aligned adjacent to one another as illustrated in FIG. 5 a spacer element 60 bridges a gap between the panels 50 and a support frame element 80 such as a purlin. The spacer element 60 in this case has a T-bar 61 with arms 62, 63 which extend into the recesses 51, 52 to retain the panels 50 in position. The spacer 60 is shown in more detail in FIG. 9.

Figure 6:
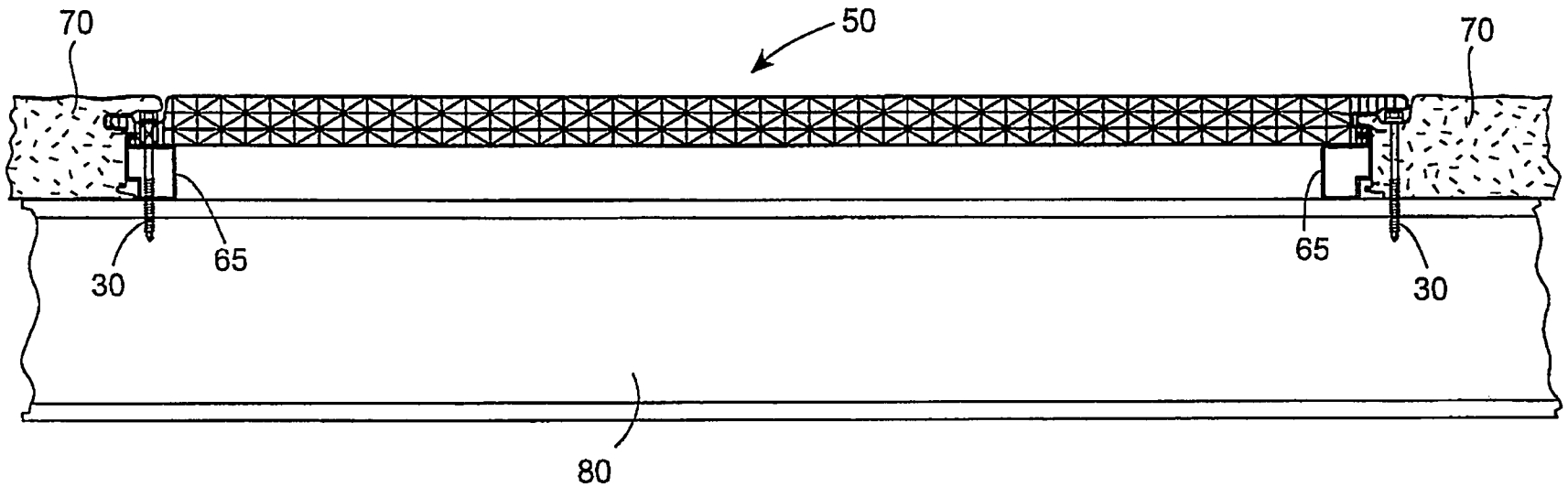
FIG. 6 is a cross-sectional view at a joint between a panel of FIGS. 3 and 4 and composite wall panels.
Figure 7:
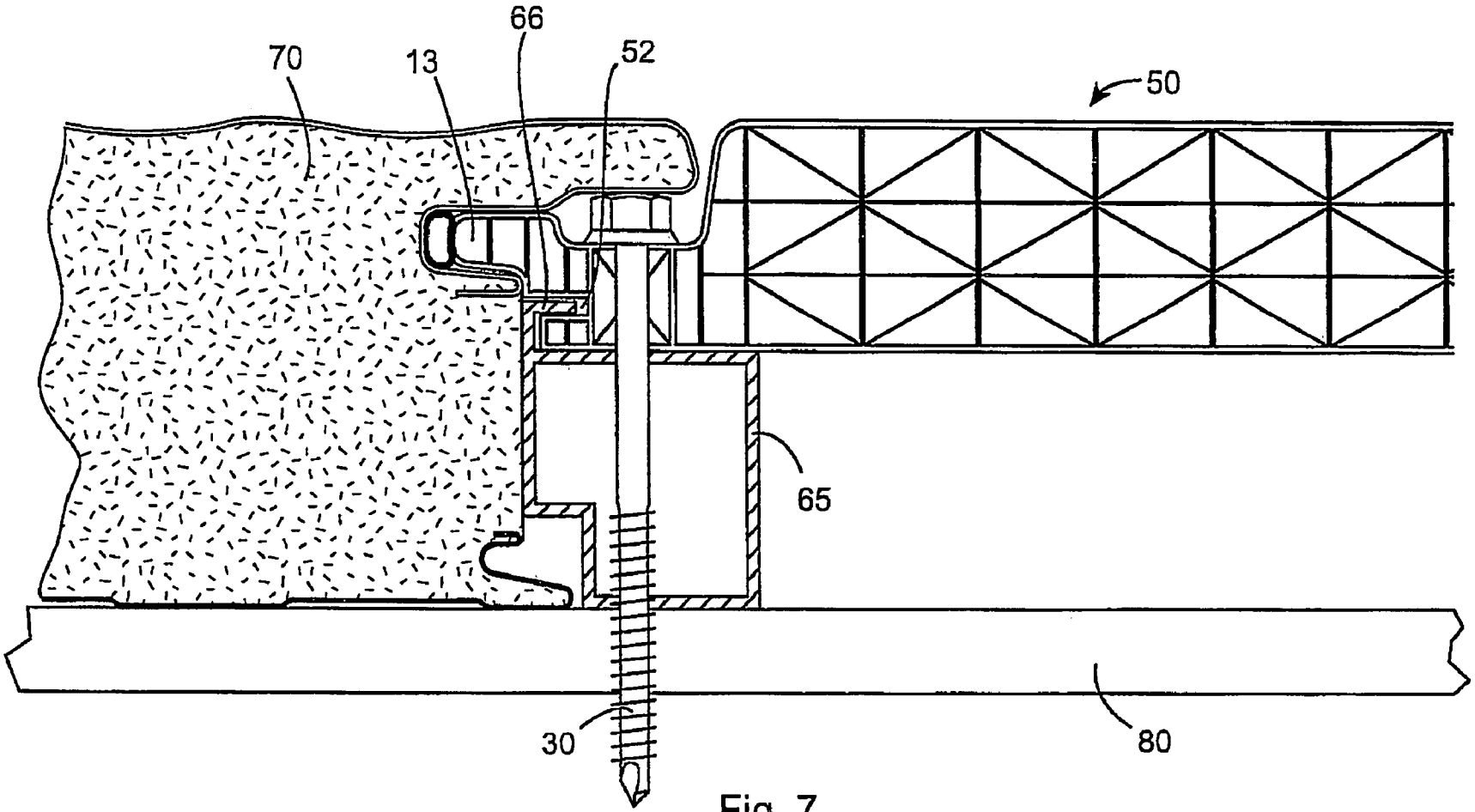
FIGS. 7 and 8 are enlarged cross-sectional views at joints of FIG. 6 between a panel of FIGS. 3 and 4 and composite wall panels.
Figure 8:
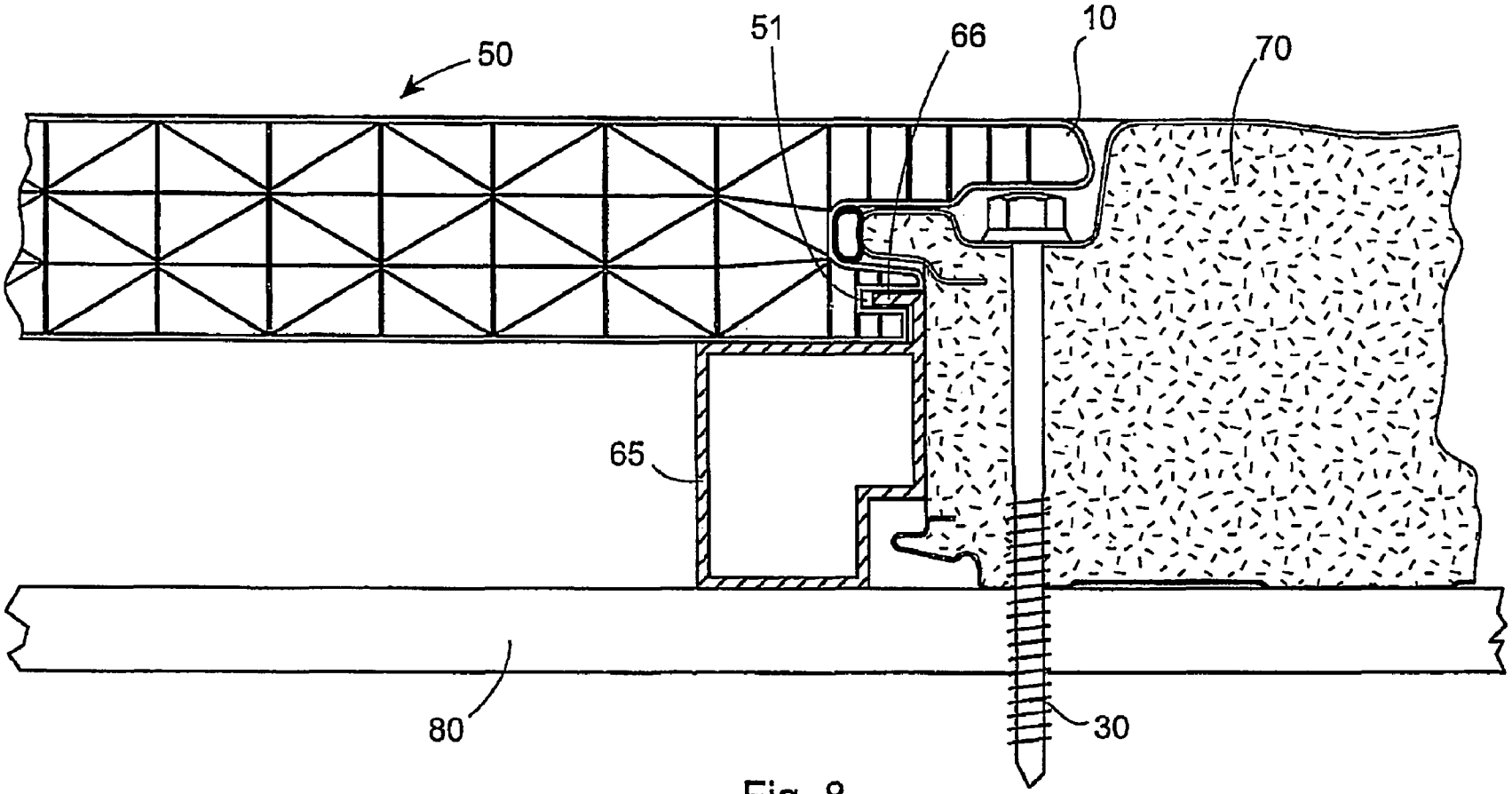
Figure 10:
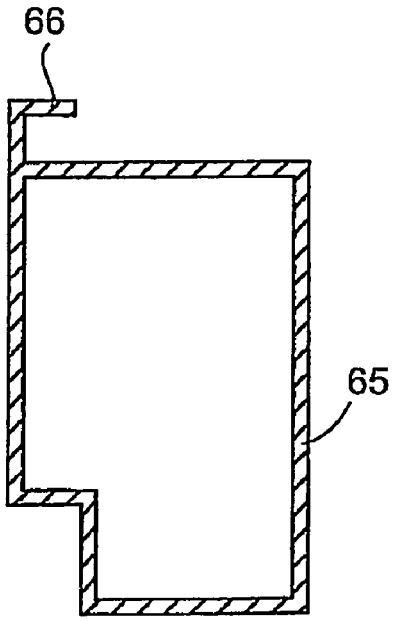
FIG. 10 is a cross-sectional view of a spacer element used in the system of FIGS. 6 to 8.

As illustrated in FIGS. 6 to 8 a translucent wall panel 50 is generally significantly thinner than a composite panel 70 which is usually used to construct the main portion of a wall. Such composite panels 70 are described for example in our GB 2325678 A. In this case a spacer 65 may be used. The spacer 65 which is shown in detail in FIG. 10 has a single leg 66 which is engaged in the spacer recess 52 on the side 6 of the translucent panel 50 or in the spacer recess 51 on the side 5 of the translucent panel 50.

The translucent wall panels of the invention have excellent U-value ratings, do not suffer from the effects of thermal expansion and provide excellent light transmission properties.

In the embodiment described the panel is comprised of a translucent polycarbonate material. It will however, be appreciated that the panel may be comprised of any suitable thermosetting material.

The translucent wall panels of the invention have advantages over prior art including the following. The provision of integral joint forming formations enables the panel to be securely connected to adjacent panels. The form of the overlap provides a positive connection between the panels for an improved weatherproof sealed finish.

One of the main advantages of the translucent panel of the invention is that it fully interfaces with a composite insulated wall panel. Hence there is no need for special integrated windows or additional on site interfacing work. The wall can be fitted just as simply as the composite panel. This translucent panel can provide, natural daylighting at a time where energy costs are increasing and hence reduce the need for artificial lighting. In addition, the translucent panel allows transmission of natural daylight for applications in factories/offices where people are working or in sports halls and the like which enhances the quality of the working/playing environment in the building.

The invention is not limited to the embodiments hereinbefore described which may be varied in detail.

The invention claimed is:

1. A translucent wall panel construction system comprising a support frame element, a wall panel being spaced from said support frame element to define a gap therebetween, said wall panel being a single body of translucent material, said wall panel having an outer weather wall;

an inner liner wall;

a longitudinally extending first side portion;

a longitudinally extending second side portion opposite to the first side portion; and a multi wall support extending between the outer weather wall and the inner liner wall, the first side portion having a first side recess portion having an end face defining a first side inner edge;

a first side outer projecting portion which defines a first side outer edge; and a first side inner projecting portion which defines a first side intermediate edge located between the first side inner edge and the first side outer edge, the second side portion having a second side projecting portion which defines a second side outer edge;

a second side outer recess portion having an end face which defines a second side inner edge; and a second side inner recess portion which defines a second side intermediate edge located between the second side outer edge and the second side inner edge, the second side portion having an integral pre-formed fixing hole having parallel sidewalls, the fixing hole extending between the second side inner edge and the second side intermediate edge, the fixing hole extending through the panel from the outer weather wall to the inner liner wall;

the first side recess portion being of generally complementary size and geometric shape to the second side projecting portion;

the first side inner projecting portion being of generally complementary size and geometric shape to the second side inner recess portion; and the first side outer projecting portion being of generally complementary size and geometric shape to the second side outer recess portion so that the first side outer projecting portion covers the fixing hole in a second side of another like panel at a joint therebetween, a spacer engaging the wall panel between the outer weather wall and the inner liner wall and the spacer also bridging the gap between and contacting an innermost portion of the inner liner wall of the wall panel and the support frame element and thereby spacing the innermost portion of the inner liner wall of the wall panel away from the support frame element and a fixing element extending through the fixing hole, the fixing element extending through the spacer and engaging the support frame element.

2. The translucent wall panel construction system as claimed in claim 1, wherein a shaft of the fixing element is spaced inwardly from the sidewall of the fixing hole.

3. The translucent wall panel construction system as claimed in claim 1,wherein the translucent material comprises a translucent thermosetting material.

4. The translucent wall panel construction system as claimed in claim 1, wherein the translucent material comprises a polycarbonate material.

5. The translucent wall panel construction system as claimed in claim 1, wherein the spacer supports adjacent edges of two adjacent translucent wall panels.

6. The translucent wall panel construction system as claimed in claim 1, wherein at least one side has spacer recesses to receive a portion of a spacer bar.

7. The translucent wall panel construction system as claimed in claim 6, wherein both sides have spacer recesses.

8. The translucent wall panel construction system as claimed in claim 7, wherein the spacer recesses are aligned.

9. A translucent wall panel construction structure incorporating a construction system as claimed in claim 1.

* * * * *